United States Patent [19]

Morris et al.

[11] Patent Number: 4,929,216

[45] Date of Patent: May 29, 1990

[54] ROTATING RING AND CHARACTER TOY

[75] Inventors: Lamont C. Morris, Chicago; Wayne A. Kuna, River Forest; Rouben T. Terzian, Chicago, all of Ill.

[73] Assignee: Marvin Glass & Associates, Chicago, Ill.

[21] Appl. No.: 255,763

[22] Filed: Oct. 11, 1988

[51] Int. Cl.[5] ..... A63H 11/08; A63H 29/08; A63H 5/00; A63H 17/26

[52] U.S. Cl. ..... 446/324; 446/169; 446/272; 446/280; 446/449; 273/128 A

[58] Field of Search ..... 446/169, 168, 171, 173, 446/233, 234, 236, 237, 238, 268, 269, 272, 274, 275, 279, 280, 288, 396, 437, 431, 450, 451, 324, 325, 326, 435, 449, 409, 411; 273/424, 425, 428, 128 A, 126 R, 126 A

[56] References Cited

U.S. PATENT DOCUMENTS

| | | | |
|---|---|---|---|
| 2,232,244 | 2/1941 | Kiefer | 446/269 |
| 2,351,762 | 6/1944 | Hoover | 446/269 |
| 2,400,981 | 5/1946 | Dishmaker | 446/449 |
| 2,747,328 | 5/1956 | Zalkind | 446/411 X |
| 2,937,475 | 5/1960 | Crawford | 446/409 X |
| 3,475,855 | 11/1969 | Edwards | 446/431 |
| 3,571,970 | 3/1971 | Dunn | 446/451 |
| 3,682,477 | 8/1972 | Harkins | 446/237 X |
| 3,825,263 | 7/1974 | Santangelo | 273/425 X |
| 4,203,251 | 5/1980 | Malek et al. | 446/236 |
| 4,610,637 | 9/1986 | Ferguson | 446/451 X |

FOREIGN PATENT DOCUMENTS

| | | | |
|---|---|---|---|
| 20674 | 9/1955 | Fed. Rep. of Germany | 446/279 |
| 8907 | 9/1956 | Fed. Rep. of Germany | 446/322 |
| 607501 | 7/1926 | France | 446/450 |
| 2128097 | 4/1984 | United Kingdom | 446/280 |

*Primary Examiner*—Robert A. Hafer
*Assistant Examiner*—D. Neal Muir
*Attorney, Agent, or Firm*—John S. Pacocha

[57] ABSTRACT

A cylindrical ring and a character having a number of extending parts that are circumscribed by a circle having a diameter equal to the inside diameter of the ring are readily combinable by a child to make a rotating toy. Insertion and removal of the character from the inside of the ring are facilitated by making the ring of a deformable material. The combined ring and character are placed in a vehicle in contact with the vehicle wheels so that as the vehicle is moved along a playing surface, the wheels rotate the combined ring and character. Part of the vehicle body is hinged for closing an opening through which the combined ring and character are inserted. Above the ring is a transparent dome in which a ball is positioned in contact with the ring so that as the combined ring and character rotate, the ball rotates within the dome. Other accessories provide rotatable surfaces which engage the outer curved surface of the cylindrical ring to rotate the combined ring and character. Yet another accessory provides surfaces on which the combined ring and character roll, under the force of gravity, and produce a bell ringing action.

16 Claims, 2 Drawing Sheets

ROTATING RING AND CHARACTER TOY

BACKGROUND OF THE INVENTION

1. Field of the Invention

This invention relates generally to toys and more particularly to combinations of cylindrical rings with readily insertable toy characters and accessories that rotate the combined rings and characters.

2. Background Art

Toys with rotating features are old in the art and there have been a number of toys in which rotation of wheels or the like produces rotation of another element. Thus, for example, U.S. Pat. No. 1,796,811 issued Mar. 17, 1931 to Shepherd; U.S. Pat. No. 2,496,603 issued Feb. 7, 1950 to Schwanengel; U.S. Pat. No. 2,577,102 issued Dec. 4, 1951 to Bolger; and U.S. Pat. No. 2,718,728 Sept. 27, 1955 to Shoup show toys in which a rotating element is secured in engagement with a plurality of surface engaging rotating wheels to produce rotation of the element. In U.S. Pat. No. 2,383,232 issued Aug. 21, 1945 to Ayres and U.S. Pat. No. 4,610,637 ssued Sept. 9, 1986 to Ferguson, a cylindrical rotating element is readily removable by the child. Instead of a cylindrical element, U.S. Pat. No. 3,078,619 issued Feb. 26, 1963 to Brown shows a readily removable egg-shaped or ovoid shaped element that tumbles as it engages the rotating surface engaging wheels. U.S. Pat. No. 4,463,518 Aug. 7, 1984 to Smathers et al. discloses a vehicle carrying a releasable top that is rotated through a gear train by rotation of the vehicle wheels and which is ejected from the vehicle when the vehicle is stopped. A toy doll stroller and Ferris wheel is disclosed in U.S. Pat. No. 4,476,649 issued Oct. 16, 1984 to Zaruba with the Ferris wheel carrying pivotable seats being rotated by engagement of the rotating rear ground wheels of the stroller. In all these prior art toys, the rotating element is not composed of separable portions readily combinable by the child. Moreover, there exists a need for additional entertaining actions to be effected by indirect rotation of a combined ring and character rotating toy.

SUMMARY OF THE INVENTION

The present invention is concerned with providing a combined rotating ring and an insertable character toy. A character with a number of extending parts, the ends of which parts are circumscribed by a circle of a diameter substantially equal to the inner diameter of a cylindrical ring, fits into the ring. Relative flexibility of one to the other facilitates easy insertion and removal by a child and also provides a friction fit to retain the character within the ring during rotation. Various accessories provide rotatable surfaces which engage the outer curved surface of the cylindrical ring to rotate the combined ring and character. Yet another accessory provides different surfaces on which the combined ring and character roll, under the force of gravity, and produce a bell ringing action.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
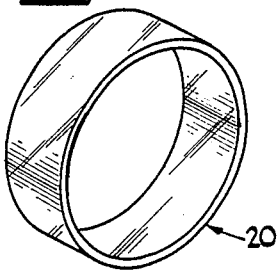
FIG. 1 is a perspective view of a ring comprising an embodiment of the present invention.
Figure 2:
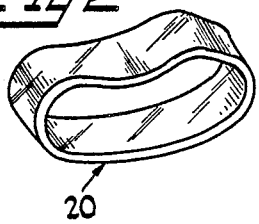
FIG. 2 is a perspective view of the ring shown in FIG. 1 in a deformed state.
Figure 3:
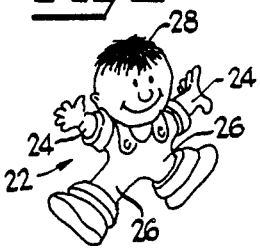
FIG. 3 is a perspective view of a toy character comprising, in combination with the ring shown in FIGS. 1 and 2, an embodiment of the present invention.

Referring now to the drawings in which like parts are designated by like reference numerals throughout the several views, FIG. 1 shows a clear, flexible, cylindrical ring 20 molded of polyurethane plastic. As illustrated in FIG. 2, ring 20 is deformable from its normal cylindrical shape as a result of a child squeezing it. A toy character 22 which may be molded of polystyrene or any of the other plastics commonly used in the molding of toy characters or figurines is shown in FIG. 3. While character 22 may be of any desired style, it should be configured with outstretched limbs such as arms 24 and legs 26, the extremities of which, together with the top of head 28 are circumscribed by a circle, the diameter of which equals or is slightly greater than the inside diameter of ring 20 so that character 22 may be positioned and frictionally retained within the ring, as is best shown in FIG. 4.

Flexible polyurethane plastic ring 20 will, after deformation from the cylindrical shape shown in FIG. 1 to a shape like that shown in FIG. 2, eventually return to the cylindrical shape because the flexible polyurethane plastic has a memory. However, by inserting the substantially rigid character 22 into the deformed ring, the child may more immediately return the ring to its cylindrical shape. Although a character having only two extending parts, the extremities of which are circumscribed by the inner diameter of the cylindrical ring, would be capable of being inserted into the ring, a greater number of such extremities are desirable to facilitate positioning of the character within the ring and to provide spoke-like support for the ring when the character is inserted into the ring in a deformed state like that shown in FIG. 2.

Figure 4:
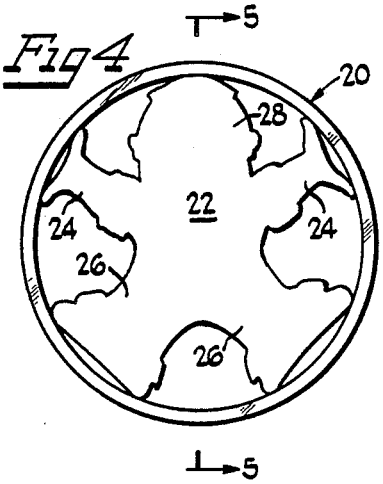
FIG. 4 is an enlarged scale, front elevational view of the ring and character combined.
Figure 5:
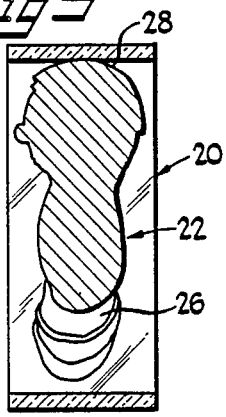
FIG. 5 is a sectional view taken generally along line 5—5 of FIG. 4.

The combined character and ring shown in FIGS. 3 and 4 may be freely rolled by a child across any generally planar surface for the pleasure of watching the character roll in a cartwheel-like fashion across the surface. In addition, the combined ring and character may be rolled in competition with other combined ring and characters in races, distance contests and the like. However, the combined ring and character may also be used in various accessories that enhance the play and entertainment value of the toy.

Figure 6:
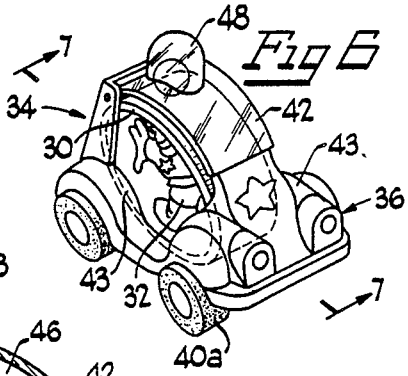
FIG. 6 is a perspective view of another embodiment of the present invention.
Figure 7:
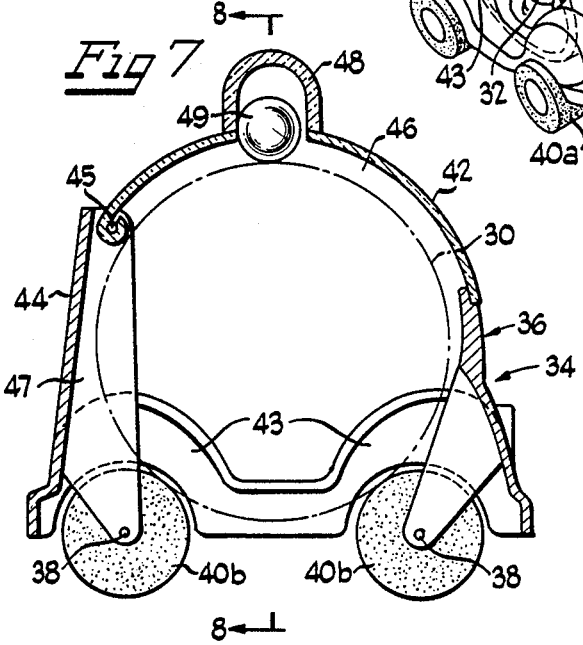
FIG. 7 is an enlarged scale, sectional view taken generally along line 7—7 of FIG. 6.
Figure 8:
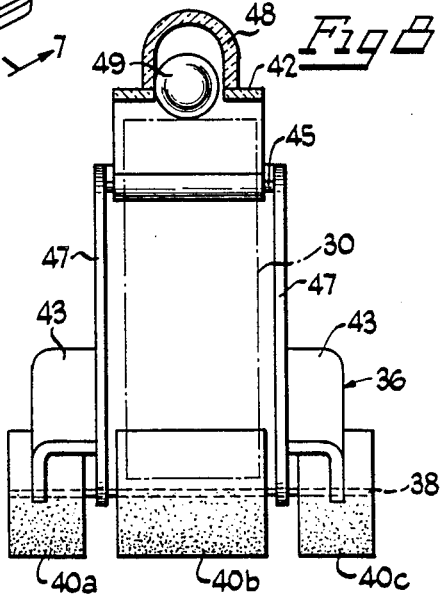
FIG. 8 is a sectional view taken generally along line 8—8 of FIG. 7.

FIGS. 6–8 show a combined ring 30 and character 32 that are further combined with a vehicle accessory 34. With vehicle accessory 34 styled as a police vehicle, character 32 is conveniently, by graphics and/or molded features, styled as a policeman. Vehicle 34 has a body 36 that carries a pair of generally parallel, spaced apart axles 38 on which roller wheels 40*a*, 40*b* and 40*c* are secured for rotation with the axles.

Secured to body 36 is a hinged transparent, plastic roof-window hatch 42 which, together with fenders 43 and back part 44, define an enclosure for the combined ring and character. Adjacent its back edge, roof-window hatch 42 pivots about a pin 45 carried by back part 44. When hatch 42 is pivoted upwardly, combined ring 30 and character 32 may be inserted down into the interior of vehicle 34 so that the ring rests upon rollers 40. Vehicle 34 is designed with sufficiently large side openings 46 to permit the inserted combined ring and character to be viewed. However, fenders 43 and side portions 47 of back part 44 block the combined ring and character from removal in a direction parallel to the axis of the ring so that when hatch 42 is closed, the combined ring and character are secured within the vehicle.

Roof-window hatch 42 includes a transparent hollow dome 48. Prior to inserting the combined ring and character, a colored ball or marble 49, of a size that permits free movement of the ball or marble within dome 48, is inserted into the dome. Ball or marble 49 then rests upon the outer curved surface of ring 30. As vehicle 34 is rolled along a surface, roller wheels 40 rotate as a result of frictional engagement with the surface and in turn cause rotation of the combined ring and character. Thus, as vehicle 34 is moved forwardly, the combined ring and character will rotate in a counterclockwise direction as viewed in FIGS. 6 and 7. Rotation of the combined ring and character will produce rotation of the ball or marble 49 to simulate the flashing dome light of a police vehicle.

Figure 9:
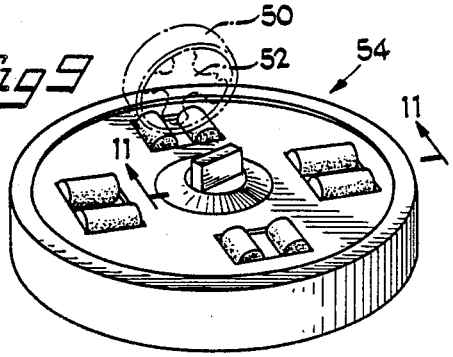
FIG. 9 is a perspective view of yet another embodiment of the present invention.
Figure 10:
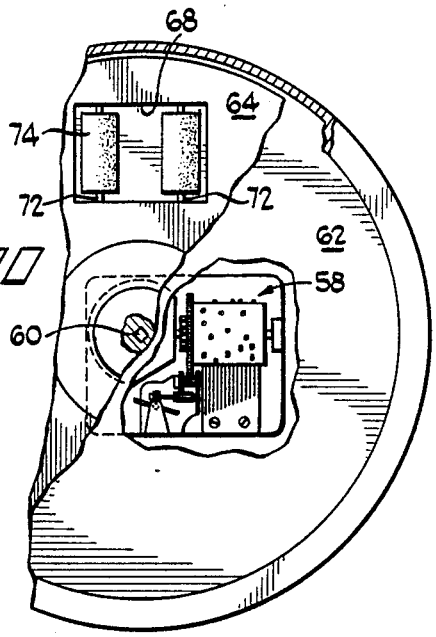
FIG. 10 is an enlarged scale, fragmentary view, partially broken away.
Figure 11:
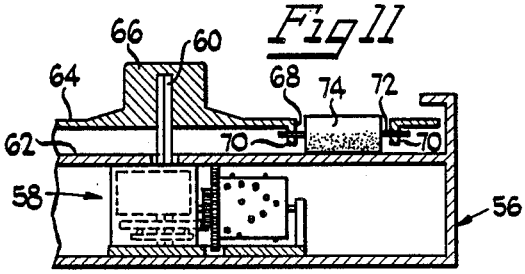
FIG. 11 is an enlarged scale, fragmentary sectional view taken generally along line 11—11 of FIG. 9.

In FIGS. 9–11 a combined ring 50 and character 52 are shown on a motor driven turntable accessory 54 which can rotate up to four of such ring and character combinations around the generally vertical axis of the turntable and simultaneously rotate each combined ring and character about the generally horizontally disposed axis of the ring. Turntable 54 includes a base housing 56 within which a conventional wind-up spring motor music box mechanism 58 such as a Sankyo musical movement Model 18N-2F123 is mounted. Music box motor 58 is in driving engagement with a square shaft 60 that extends generally vertically upward through an upper stationary plate 62 that is part of housing 56.

On top of shaft 60, in driving engagement with shaft 60, is a disk 64, the central portion of which is formed as a knob 66 to facilitate manual turning of shaft 60 to wind motor 58. Intermediate the outer periphery of disk 64 and central knob 66, are four, substantially equidistant, rectangular openings 68, opposed sides of which are formed by downwardly depending walls 70 of disk 64. Journaled between the opposed sidewalls 70 of each of the openings 68 are a pair of spaced apart axles 72. Mounted for rotation on each of the axles is a roller 74. Each roller 74 is in contact with the upper surface of plate 62.

Thus, as disk 64 is rotated around the axis of shaft 60, each roller 74 is rotated about the axis of its respective axle 72 by frictional engagement with the upper surface of stationary plate 62. As each pair of rollers 74 rotates about their respective axles, they rotate a combined ring and character generally about the axis of the ring while also carrying the combined character and ring around the axis of shaft 60.

Figure 12:
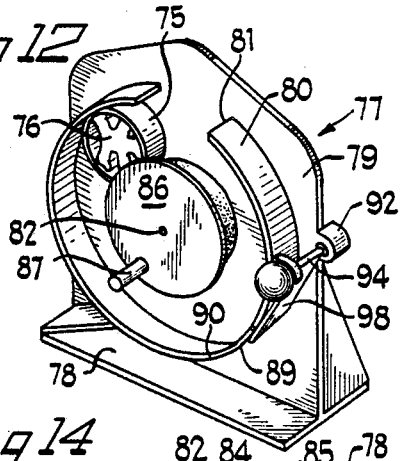
FIG. 12 is a perspective view of still another embodiment of the present invention.
Figure 13:
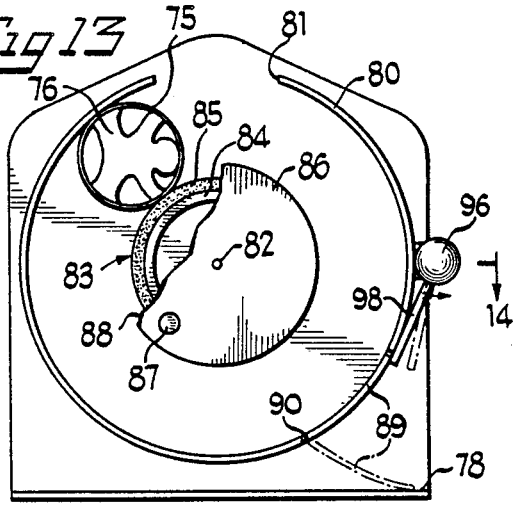
FIG. 13 is an enlarged scale front plan view.
Figure 14:
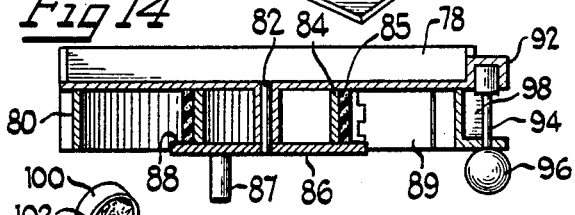
FIG. 14 is a sectional view taken generally along line 14—14 of FIG. 12.

Yet another accessory for imparting an entertaining movement to a combined ring 75 and character 76 is shown in FIGS. 12–14. Accessory 77 has a base 78 designed to be placed on a substantially flat playing surface such as a floor or table. Projecting upwardly from generally horizontal base 78 is a generally vertical plate 79. Extending outwardly from one side of vertical plate 79 is a circular wall 80 in which there is an opening 81 adjacent the upper end of plate 79. Opening 81 is sufficiently large to permit passage of ring 75.

Mounted in plate 79 is a shaft 82, the axis of which is generally the center of wall 80. Carried for rotation about shaft 82 is a drum 83 with a hollow core 84 having a soft foam outer covering 85. Across the outer planar surface of drum 83, opposite plate 79, is a cover disk 86. Adjacent the periphery of disk 86, a handle 87 projects outwardly. Disk 86 has a diameter greater than that of drum 83 with foam covering 85 so as to form a flange 88 extending beyond foam 85.

The distance along a radius from the center of shaft 82 between the inside of wall 80 and the outside of foam 85 is slightly less than the outside diameter of ring 75. Accordingly, as drum 83 is manually rotated about axle 82, ring 75 and character 76 are driven around the annular space between circular wall 80 and foam 85 as ring 75 and character 76 are simultaneously rotated generally about the axis of ring 75. Flange 88, formed by the peripheral portion of disk 86 that extends beyond foam 85, serves to retain ring 75 and character 76 from falling out the open front of accessory 77.

Near the bottom of circular wall 80, approximately between the four and five o'clock position as viewed in FIGS. 12 and 13, is a hinged portion 89 that pivots about a pin 90 so that portion 89 may drop down toward base 78. On the side of plate 79 is a boss 92 having a bore into which a shaft 94 is frictionally fitted. The free end of shaft 94 has a knob 96. Extending radially from the axis of shaft 94 is a finger 98 that may be rotated into contact with the free edge of hinged curved wall portion 89 and the adjacent free edge of the curved wall 80 to maintain portion 89 in the closed position illustrated in FIGS. 12, 13 and 14. When shaft 94 is rotated counterclockwise as indicated by the arrow in FIG. 13 to move finger 98 to the broken line illustrated position, curved wall portion 89 will drop down to the open position illustrated in broken line. Hinged wall portion 89 is sufficiently long so that the opening created when portion 89 drops is sufficiently large to permit ring 75 and character 76 to roll out of the annular space between curved wall 80 and foam 85, down the ramp formed by open wall portion 89, and onto the generally flat playing surface on which base 78 is resting. Because opening 81 is at the top of curved wall 80 in approximately the twelve o'clock position, ring 75 and character 76 will not normally be driven out of the upper opening 81.

Figure 15:
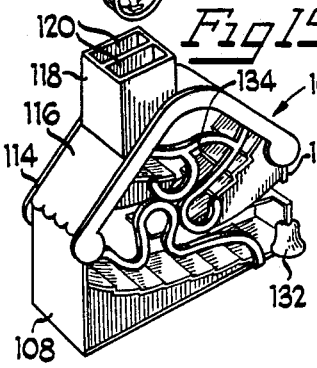
FIG. 15 is a perspective view of an additional embodiment of the present invention.
Figure 16:
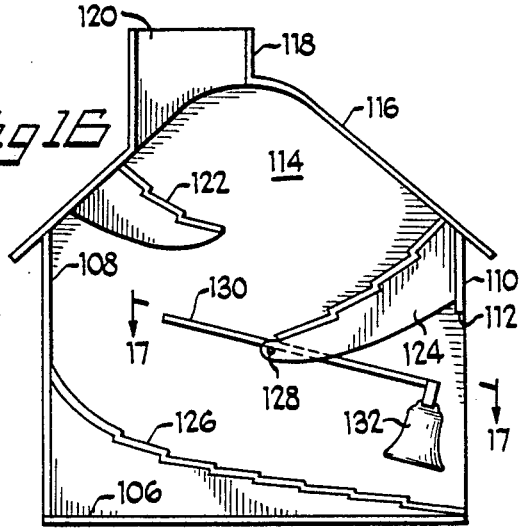
FIG. 16 is an enlarged scale, front plan view with the front grill work removed.

Besides accessories that rotate the combined rings and characters, other accessories may be provided to enhance play with the combined rotating ring and character toy. Thus, in FIGS. 15–16, a combined ring 100 and character 102 are shown with an accessory 104 in which the combined ring and character drop down a series of inclined surfaces and ring a bell before exiting. Accessory 104 is generally styled as a house having a floor 106, one sidewall 108, another sidewall 110, the lower portion of which defines an exit opening 112, a back wall 114 and a roof 116 with a chimney 118. Through the entire length of hollow chimney 118 are a pair of openings 120 of a size to permit the free passage of the combined ring 100 and character 102.

Figure 17:
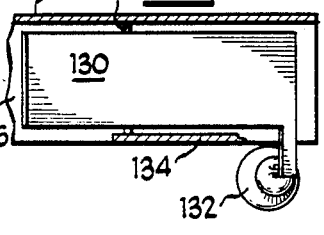
FIG. 17 is a fragmentary sectional view taken generally along line 17—17 of FIG. 16.

Extending inwardly and downwardly from the underside of roof 116, generally below the bottom of openings 120 is a downwardly stepped inclined ramp 122. Another downwardly stepped inclined ramp 124 extends downwardly and inwardly from adjacent the juncture of roof 116 and sidewall 110. Still another downwardly stepped inclined ramp 126 extends from approximately the midpoint of sidewall 108 toward exit opening 112. Mounted for pivotal movement about a fulcrum pin 128 extending across the lower end of ramp 124 is a pivoting lever 130. Attached to the end of lever 130, adjacent exit opening 112, is a bell 132, the weight of which tips lever 130 in a clockwise direction about fulcrum 128 as viewed in FIGS. 15–17.

When a combined ring 100 and character 102 are dropped through an opening 120 of chimney 118, they first hit ramp 122 down which they rotate onto ramp 124. Upon reaching the end of ramp 124, combined ring 100 and character 102 hit the upper inside end of lever 130 causing bell 132 to ring and then fall down onto ramp 126 down which they rotate and pass out of the accessory through exit opening 112. Across the open front of accessory 104 is a grill work 134 for preventing the rotating toy from falling out of the accessory while still permitting viewing of the rotating toy. For ease of illustration, grill work 134 has been omitted from FIG. 16.

Other accessories may be provided to enhance the play and entertainment value of the combined ring and character. Similarly, numerous variations may be made in the design of the character and other modifications such as making the ring more rigid and the character sufficiently flexible to insure a facile force fitting of the character into the ring by a child. While particular embodiments of the present invention have been shown and described, numerous other variations and modifications will occur to those skilled in the art. It is intended in the appended claims to cover all such variations and modifications as fall within the true spirit and scope of the present invention.

What is claimed as new and desired to be secured by Letters Patent is:

1. A toy comprising in combination:

a cylindrical ring having a central axis, an inner diameter, a cylindrical inner surface which is linear from edge to edge and an outside curved surface;

a character having two or more extremities with free ends;

the free ends being circumscribed by a circle of a diameter substantially equal to the inner diameter of the ring;

one of the ring or character being sufficiently flexible to permit insertion and removal of the character into and out of the ring while providing sufficient frictional engagement between the free ends and the inside of the ring to engage the character within the ring so that the character rotates with the ring as the ring is rolled about its outside curved surface.

2. The toy of claim 1 in which the ring is flexible and the character is substantially rigid with the ring being made of a material that will return to a cylindrical shape after being deformed.

3. The toy of claim 1 in which the character has five free ends circumscribed by a circle having a diameter substantially equal to the inner diameter of the ring.

4. The toy of claim 1 including:

a vehicle having a body;

the body carrying two spaced apart substantially parallel axles;

a wheel on each axle that rotates upon engaging a playing surface along which the vehicle is rolled; and the body being adapted to receive the combined ring and character with the outside curved surface of the ring in contact with the wheels so that as the wheels rotate, the combined ring and character is rotated generally about the axis of the ring.

5. The toy of claim 4 in which the body includes:

a hinged portion of the enclosure that is pivotable between an open position permitting insertion and removal of the combined ring and character into and out of the enclosure and a closed position for retaining the combined ring and character within the enclosure.

6. The toy of claim 5 in which:

the enclosure includes openings on either side permitting viewing of the rotating combined ring and character; and means preclude removal of the combined ring and character from the body in a direction generally parallel to the axis of the ring.

7. The toy of claim 4 in which:

the body includes a substantially transparent hollow dome; and a rotatable ball is positionable in the dome in contact with the outer curved surface of the ring so that as the combined ring and character rotate, the ball is rotated within the dome.

8. The toy of claim 1 including:

a motor driven turntable;

the turntable having a stationary surface and a disk above the stationary surface that rotates relative to the stationary surface about a central axis;

the disk having an opening;

a pair of spaced apart, substantially parallel rollers extending across the opening;

the rollers being in engagement with the stationary surface; and the combined ring and character being positionable atop the rollers so that as the disk is rotated about its central axis, the combined ring and character is both moved around the central axis of the disk and rotated substantially about the axis of the ring.

9. The toy of claim 1 including:

a base supporting a substantially vertical plate;

an axle extending out transversely from the plate;

a drum rotatable about the axle;

a circular wall extending out transversely from the vertical plate and spaced from the drum to define an annular space;

the drum having an outer surface;

a resilient material around the outer surface of the drum; and the combined ring and character fitting into the annular space upon compression of the resilient surface and being in frictional engagement with the resilient surface so that rotation of the drum effects movement of the combined ring and character around the annular space while simultaneously rotating the combined ring and character generally about the axis of the ring.

10. The toy of claim 9 in which a portion of the circular wall is pivotable between a closed position in which the pivotable portion forms a substantially contiguous part of the curved wall and an open position leaving an opening large enough in the curved wall to permit the combined ring and character to exit the annular space.

11. The toy of claim 10 including latch means for retaining the pivotable wall portion in the closed position.

12. The toy of claim 1 including:

a housing having generally upstanding sidewalls, a bottom and a top;

an entrance opening in the top permitting insertion of a combined ring and character;

an exit opening in one of the sidewalls adjacent the bottom; and a plurality of ramps alternately angled downwardly and inwardly from the opposed sidewalls so that as the combined ring and character are dropped down through the entrance opening they roll and drop from one ramp to the other and exit the housing through the exit opening.

13. The toy of claim 12 including:

a lever pivotally mounted adjacent the end of one of the ramps;

the lever having an upper end and a lower end;

the upper end being engagable by the combined ring and character as it rolls down the ramp; and the lower end having a bell so that when the upper end of the lever is engaged by the combined ring and character, the bell rings.

14. The toy of claim 7 in which:

the body includes an enclosure over the wheels;

the enclosure includes a hinged portion that is pivotable between an open position permitting insertion and removal of the combined ring and character into and out of the enclosure and a closed position for retaining the combined ring and character within the enclosure;

the dome is part of the hinged portion; and the dome has an opening so that when the hinged portion is in the closed position, and the combined ring and character is inserted in the enclosure, the ball is in contact with the ring.

15. A toy comprising in combination:

a cylindrical ring having a central axis, an inner diameter and an outside curved surface;

a character having two or more extremities with free ends;

the free ends being circumscribed by a circle of a diameter substantially equal to the inner diameter of the ring;;

one of the ring or the character being sufficiently flexible to permit insertion and removal of the character into and out of the ring while providing sufficient frictional engagement between the free ends and the inside of the ring to retain the figure within the ring as the ring is rolled about its outside curved surface;

a vehicle having a body;

the body carrying two spaced apart substantially parallel axles;

a wheel on each axle that rotates upon engaging a playing surface along which the vehicle is rolled;

the body being adapted to receive the combined ring and character with the outside curved surface of the ring in contact with the wheels so that as the wheels rotate, the combined ring and character is rotated generally about the axis of the ring;

an enclosure over the wheels;

a hinged portion of the enclosure that is pivotable between an open position permitting insertion and removal of the combined ring and character into and out of the enclosure and a closed position for retaining the combined ring and character within the enclosure;

the hinged portion of the enclosure including a substantially transparent hollow dome; and a rotatable ball positionable in the dome in contact with the outer curved surface of the ring when the combined ring and character is inserted in the enclosure and the hinged portion is in the closed position, so that as the combined ring and character rotate, the ball is rotated within the dome;

16. A toy comprising in combination:

a vehicle having a body;

the body carrying two spaced apart substantially parallel axles; p1 a wheel on each axle that rotates upon engaging a playing surface along which the vehicle is rolled;

the body being adapted to removably receive a first rotatable element in contact with the wheels so that as the wheels rotate, the first rotatable element is rotated generally about an axis generally parallel to the axles;

an enclosure over the wheels;

a hinged portion of the enclosure that is pivotable between an open position permitting insertion and removal of the first rotatable element into and out of the enclosure and a closed position for retaining the first rotatable element within the enclosure;

the hinged portion of the enclosure including a substantially transparent hollow dome; and a second rotatable element is positionable in the dome in contact with the first rotatable element when the first rotatable element is inserted in the enclosure and the hinged portion is in the closed position, so that as the first rotatable element rotates, the second rotatable element is rotated within the dome.

* * * * *